US010511901B2

(12) United States Patent
Garrett

(10) Patent No.: US 10,511,901 B2
(45) Date of Patent: Dec. 17, 2019

(54) ADAPTABLE EAR TIP FOR HEADPHONES

(71) Applicant: BOSE CORPORATION, Framingham, MA (US)

(72) Inventor: George Sean Garrett, Sherborn, MA (US)

(73) Assignee: BOSE CORPORATION, Framingham, MA (US)

( * ) Notice: Subject to any disclaimer, the term of this patent is extended or adjusted under 35 U.S.C. 154(b) by 92 days.

(21) Appl. No.: 15/481,187

(22) Filed: Apr. 6, 2017

(65) Prior Publication Data

US 2018/0295439 A1 Oct. 11, 2018

(51) Int. Cl.

| | |
|---|---|
| ***H04R 1/10*** | (2006.01) |
| ***H04R 29/00*** | (2006.01) |
| ***H04R 25/00*** | (2006.01) |

(52) U.S. Cl.

CPC ..... *H04R 1/1016* (2013.01); *H04R 1/1041* (2013.01); *H04R 1/1091* (2013.01); *H04R 29/001* (2013.01); *H04R 25/652* (2013.01); *H04R 2420/07* (2013.01); *H04R 2460/15* (2013.01)

(58) Field of Classification Search

USPC ..... 381/56, 58, 59, 71.6, 74, 322, 328, 370, 381/380

See application file for complete search history.

(56) References Cited

U.S. PATENT DOCUMENTS 9,002,023 B2 * 4/2015 Gauger, Jr. ..... H04R 29/001 381/328
9,813,795 B2 * 11/2017 Daley ..... H04R 1/1016

* cited by examiner

*Primary Examiner* — Yosef K Laekemariam
(74) *Attorney, Agent, or Firm* — Lando & Anastasi, LLP

(57) ABSTRACT

A method of customizing the fit of a portion of an in-ear audio device within a portion of an ear includes determining a degree of sealing between the in-ear audio device and the portion of the ear and applying a voltage to at least a portion of an ear tip coupled to the in-ear audio device to selectively expand or contract the portion of the ear tip based on the determination until the degree of sealing between the in-ear audio device and the portion of the ear achieves a desired degree of sealing.

21 Claims, 15 Drawing Sheets

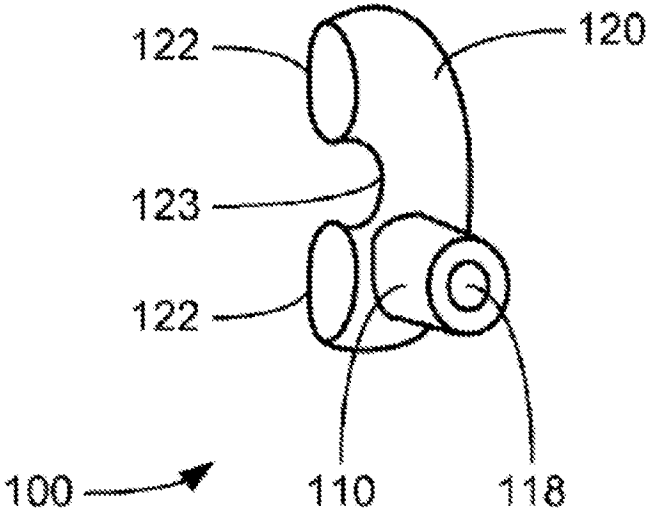
FIG. 1b
FIG. 1a
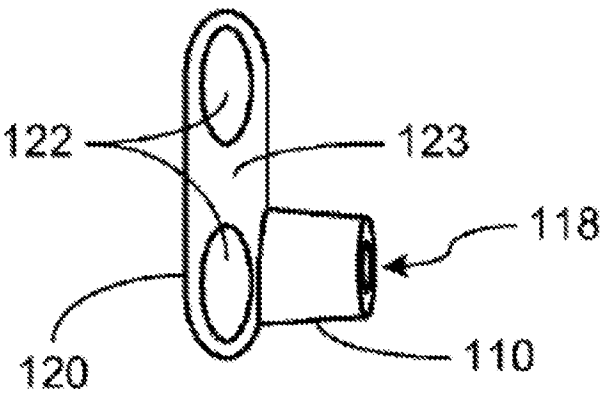

ADAPTABLE EAR TIP FOR HEADPHONES

TECHNICAL FIELD

Aspects and implementations of the present disclosure are directed generally to customizing the fit of an in-ear audio device within a portion of an ear.

BACKGROUND

The use of audio devices structured to be at least partly inserted into one or both ears of a user (e.g., so called "in-ear" audio devices or "intra-aural" audio devices) to enable audio to be acoustically output to one or both ears of a user has become commonplace, especially with the widespread use of digital audio recording playback devices (e.g., MP3 digital file players) and two-way wireless communications devices (e.g., cell phones and personal data assistant devices incorporating cell phone capabilities). In-ear audio devices with noise-cancelling features typically benefit from a seal within the ear canal to provide noise-cancelling signals within a controlled environment. However, difficulties remain in providing in-ear audio devices that fit comfortably in users' ears, and that fit well enough to cooperate with the structure of the ear to provide a high quality of sound in the acoustic output of audio. Much of the reason for this difficulty is that no two ears have shapes that are exactly alike, such that an in-ear audio device that is able to provide a good fit in an ear of one user may be unable to do so in an ear of another user.

One solution is to provide in-ear audio devices with a selection of removable hollow ear couplings that are each shaped and/or sized differently to enable the in-ear audio devices to be used with different dimensions and shapes of ears. However, as is well-known to the users of in-ear devices, achieving a good fit can be difficult even with in-ear audio devices that are supplied with a relatively extensive assortment of hollow ear couplings from which to choose.

SUMMARY

In accordance with an aspect of the present disclosure, there is provided a method of customizing the fit of a portion of an in-ear audio device within a portion of an ear. The method comprises determining a degree of sealing between the in-ear audio device and the portion of the ear and applying a voltage to at least a portion of an ear tip coupled to the in-ear audio device to selectively expand or contract the portion of the ear tip based on the determination until the degree of sealing between the in-ear audio device and the portion of the ear achieves a desired degree of sealing.

In some implementations, determining a degree of sealing between the in-ear audio device and the portion of the ear comprises driving an acoustic driver of the in-ear audio device to acoustically output a test sound into an ear canal of the ear, and monitoring a microphone that is acoustically coupled to the ear canal to detect sounds within the ear canal that are indicative of the frequency response of the acoustic driver acoustically outputting the test sound into the ear canal.

In some implementations, the method further comprises applying the voltage to at least a portion of the ear tip while the acoustic driver is driven to acoustically output the test sound and the microphone is monitored.

In some implementations, the method further comprises employing the sounds detected by the microphone that are indicative of the frequency response of the acoustic driver acoustically outputting the test sound into the ear canal to determine if the degree of sealing between the in-ear audio device and the portion of the ear achieves a desired quality of frequency response of the acoustic driver acoustically outputting the test sound.

In some implementations, monitoring the microphone comprises monitoring a built-in microphone disposed within a casing of the in-ear audio device.

In some implementations, the voltage is applied to a piezoelectric material within the ear tip, and the piezoelectric material expands or contracts based on the applied voltage.

In some implementations, the piezoelectric material is disposed within an ear canal portion of the ear tip of the in-ear audio device.

In some implementations, the piezoelectric material is disposed within a concha portion of the ear tip of the in-ear audio device.

In some implementations, the method further comprises monitoring a pressure exerted by the in-ear audio device coupling to the portion of the ear and ceasing application of the voltage to at least the portion of the ear tip in response to the level of pressure being outside a predetermined range of pressure levels.

In some implementations, the method further comprises monitoring a manually-operable control for an indication of the degree of sealing due to applying the voltage causing discomfort to a user of the in-ear audio device and ceasing application of the voltage to at least the portion of the ear tip in response to the indication.

In accordance with another aspect of the present disclosure, there is provided an in-ear audio device. The in-ear audio device comprises an ear tip comprising an ear canal portion configured to be inserted into at least an entrance of an ear canal of a user and a concha portion configured to be inserted into at least a concha of the ear of the user, wherein at least one of the ear canal portion and the concha portion comprise a piezoelectric material.

In some implementations, the ear canal portion comprises an outlet with an opening therein for directing sound from an acoustic driver towards the ear canal of the user.

In some implementations, the ear canal portion further comprises a flexible flap surrounding at least a portion of the outlet.

In some implementations, the piezoelectric material is disposed within the flap of the ear canal portion of the in-ear audio device.

In some implementations, the piezoelectric material is disposed within the outlet of the ear canal portion of the in-ear audio device.

In some implementations, the at least one of the ear canal portion and the concha portion that comprises a piezoelectric material further comprises silicone material, wherein the silicone material is disposed at an exterior surface of the ear canal portion or concha portion.

In some implementations, the in-ear audio device further comprises a processing device configured to determine a degree of sealing between the ear tip and a portion of the user's ear and apply a voltage to the piezoelectric material to selectively expand or contract the piezoelectric material based on the determination until the degree of sealing between the ear tip and the portion of the user's ear achieves a desired degree of sealing.

In some implementations, the in-ear audio device further comprises an acoustic driver for acoustically outputting a test sound into the ear canal of the ear.

In some implementations, the in-ear audio device further comprises an interior microphone that is acoustically coupled to the ear canal to detect sounds within the ear canal that are indicative of the frequency response of the acoustic driver acoustically outputting the test sound into the ear canal.

In some implementations, the processor is further configured to employ the sounds detected by the microphone that are indicative of the frequency response of the acoustic driver acoustically outputting the test sound into the ear canal to determine if the degree of sealing between the ear tip and the portion of the user's ear achieves a desired quality of frequency response of the acoustic driver acoustically outputting the test sound.

In some implementations, the in-ear audio device further comprises a pressure sensor, wherein the processing device is further configured to monitor a pressure exerted by the ear tip coupling to the portion of the ear and cease application of the voltage to the piezoelectric material in response to the level of pressure being outside a predetermined range of pressure levels.

In some implementations, the in-ear audio device further comprises a user interface comprising a manually-operable control, wherein the processing device is further caused to monitor the manually-operable control for an indication of the degree of sealing due to applying the voltage to the piezoelectric material causing discomfort to a user of the in-ear audio device and cease application of the voltage to the piezoelectric material in response to the indication.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 1*a* is a perspective view of an example of in-ear audio device;

FIG. 1*b* is another perspective view of the example of the in-ear audio device of FIG. 1*a;*

DETAILED DESCRIPTION

Figure 2A:
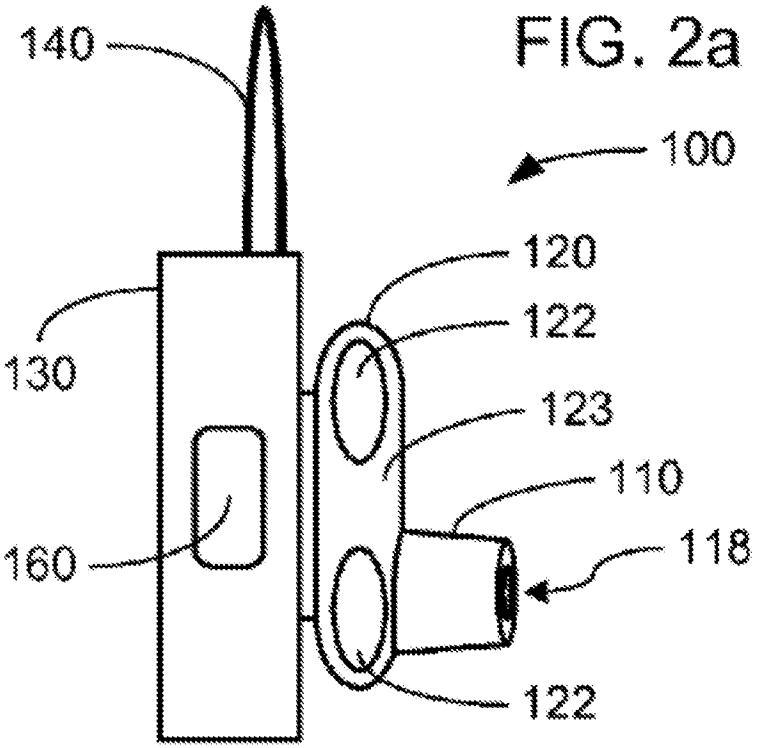
FIG. 2*a* is a perspective view of another example of in-ear audio device.

Aspects and implementations disclosed herein are not limited to the details of construction and the arrangement of components set forth in the following description or illustrated in the drawings. Aspects and implementations disclosed herein are capable of being practiced or of being carried out in various ways.

Aspects and implementations disclosed herein may be applicable to a wide variety of in-ear audio devices, i.e., devices that are structured to be used in a manner in which at least a portion of the device is positioned within the concha and/or ear canal portions of an ear of a user. It should be noted that although specific implementations of an in-ear audio device primarily serving the purpose of acoustically outputting audio are presented with some degree of detail, such presentations of specific implementations are intended to facilitate understanding through provision of examples, and should not be taken as limiting either the scope of disclosure or the scope of claim coverage.

Aspects and implementations disclosed herein may be applicable to in-ear audio devices that either do or do not support two-way communications, and either do or do not support active noise reduction (ANR). For in-ear audio devices that do support either two-way communications or ANR, it is intended that what is disclosed and claimed herein is applicable to an in-ear audio device incorporating one or more microphones disposed on a portion of the in-ear audio device that remains outside an ear when in use (e.g., feedforward microphones), on a portion that is inserted into a portion of an ear when in use (e.g., feedback microphones), or disposed on both of such portions. Still other implementations of in-ear audio devices to which what is disclosed and what is claimed herein is applicable will be apparent to those skilled in the art.

FIGS. 1*a* and 1*b*, taken together, provide two views of one implementation of an in-ear audio device 100 having a casing made up of at least a canal portion 110 meant to be positioned within at least an entrance of an ear canal of a user's ear and a concha portion 120 meant to be positioned within at least a portion of the concha of the user's ear. More specifically and as depicted, the concha portion 120 has a generally C-shaped configuration to fit within the concha of a user's ear while accommodating the complex shape of the concha as defined by portions of the tragus, anti-tragus, helix, and anti-helix of the pinna of the ear. This C-shaped configuration has a pair of extensions 122 and defines an inset curve 123 to accommodate the partial protrusion of a portion of the helix into the concha. The canal portion 110 has a generally tubular shape extending from where one end of the canal portion 110 is coupled to the concha portion 120 at a location coincident with where the entrance to the ear canal is typically located in relation to the portion of the concha defined by portions of the tragus and anti-tragus. An aperture 118 is formed in the other end of the canal portion 110 to enable sounds to be acoustically output by an acoustic driver (e.g., element 190 illustrated in FIGS. 3*a*-3*d*) positioned within the casing of the in-ear audio device 100 through the aperture 118 and into the ear canal when the in-ear audio device 100 is properly positioned in the user's ear during operation.

The implementation of the in-ear audio devices 100 depicted in FIGS. 1*a* and 1*b* may be any of a variety of types of in-ear audio device able to perform any of a variety of audio functions, including and not limited to, an in-ear earphone to acoustically output audio, an in-ear ANR device to provide a reduction in environmental noise sounds encountered by a user through the acoustic output of anti-noise sounds, and/or a two-way audio communications audio device employing detection of the user's speech sounds through bone conduction and/or a Eustachian tube connected to portions of the ear into which the in-ear audio device 100 is inserted. Further, it should be noted that although the concha portion 120 has been depicted and described as having a C-shaped configuration to fit within the concha, other implementations are possible having a somewhat differently shaped concha portion 120 that does not fill as much of the concha.

Also, although not specifically depicted, the in-ear audio device 100 may further incorporate an electrically and/or optically conductive cable to enable the in-ear audio device 100 to at least receive audio to be acoustically output by the in-ear audio device 100 from another audio device (not shown) to which the in-ear audio device 100 is coupled via such a cable. Alternatively and/or additionally, the in-ear audio device 100 may receive such audio through a wireless coupling with another device. Accordingly, electrical and electronic components such as, but not limited to a wireless receiver and/or transmitter, processor (optionally including ANS circuitry), battery, microphone, and acoustic driver may be included within the concha portion 120 and/or canal portion 110 of the in-ear audio device 100. Alternatively, such components may be included within a housing or casing coupled to the in-ear audio device.

Figure 2B:
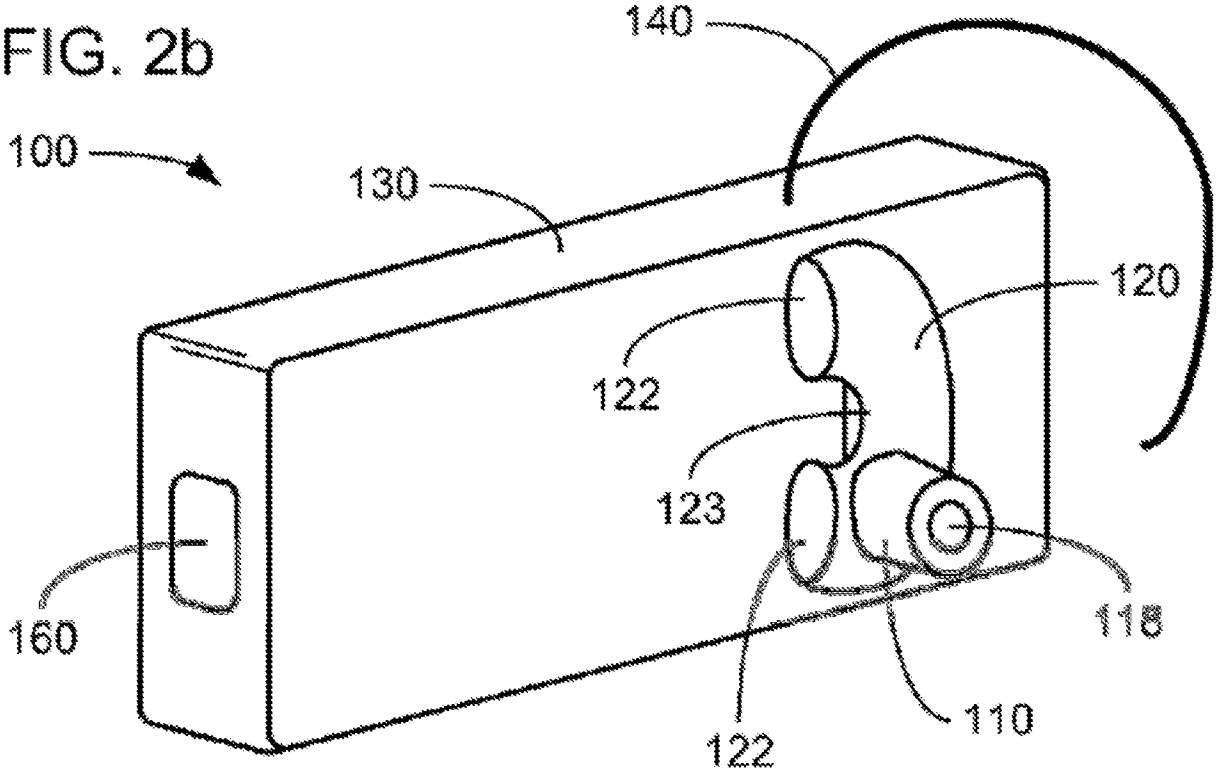
FIG. 2*b* is another perspective view of the example of the in-ear audio device of FIG. 2*a;*
Figure 2C:
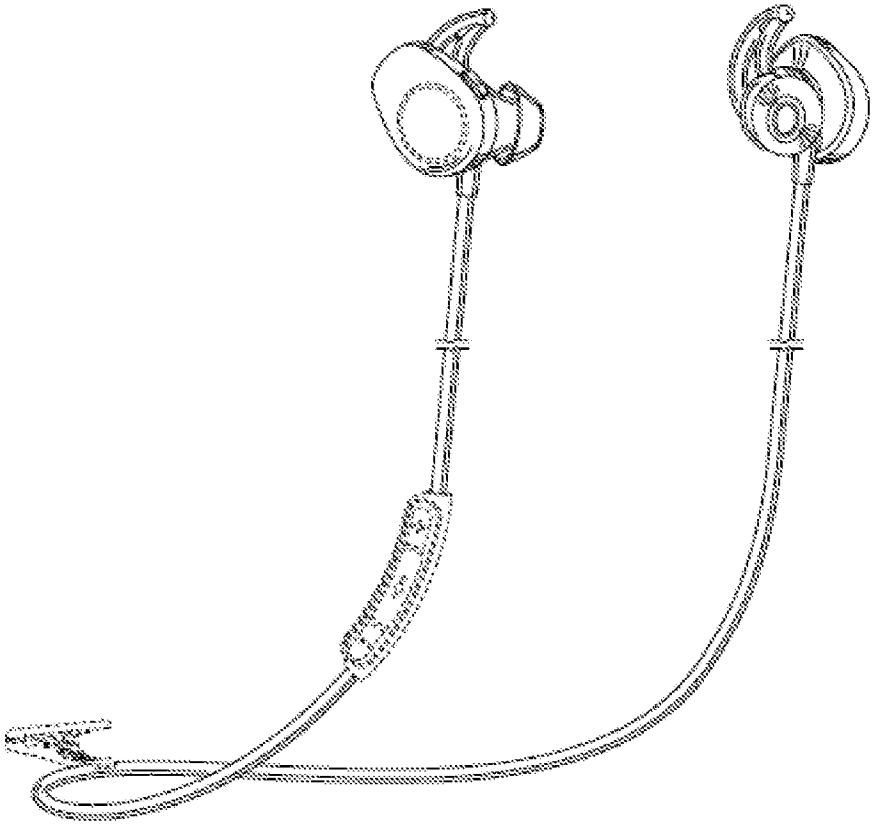
FIG. 2*c* illustrates an example of an in-ear audio device headset.
Figure 2D:
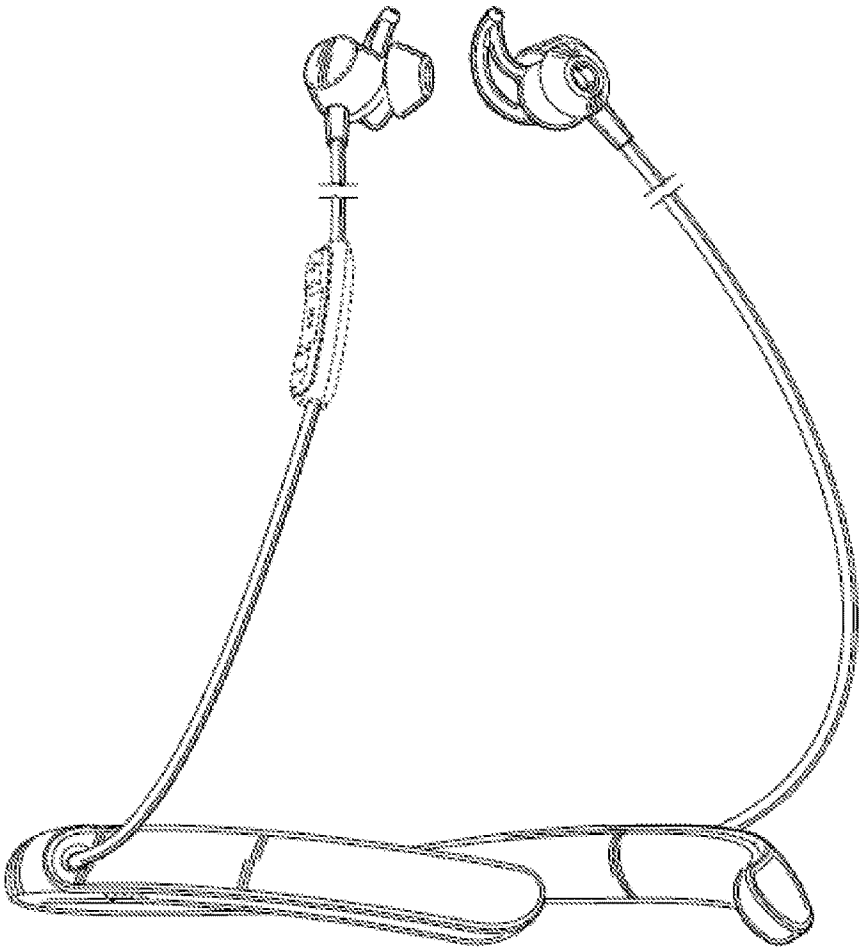
FIG. 2*d* illustrates another example of an in-ear audio device headset.
Figure 2E:
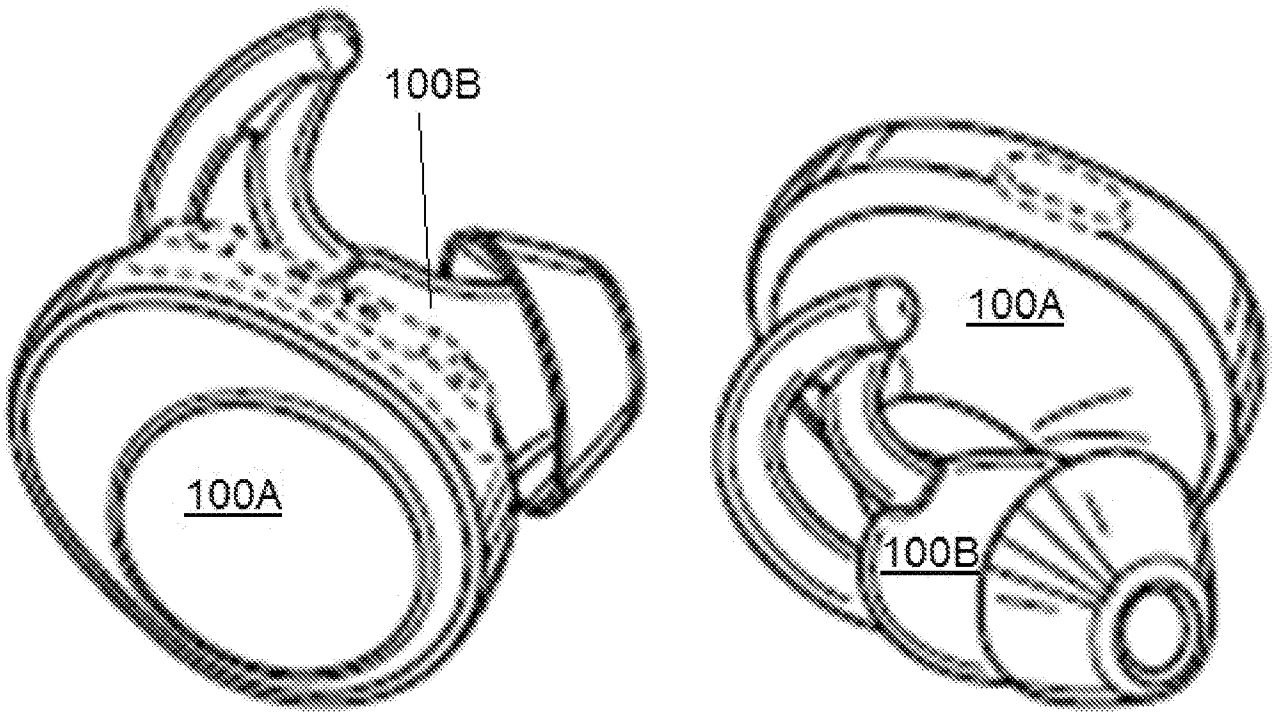
FIG. 2*e* illustrates a pair of wireless-enabled in-ear audio devices.

FIGS. 2*a* and 2*b*, taken together, provide two views of another implementation of an in-ear audio device 100 that additionally incorporates an outer portion 130 meant to be positioned alongside the pinna of a user's ear during operation, and a support portion 140 to engage a portion of the pinna during operation. More specifically, the outer portion 130 has an elongate shape with one end coupled to the concha portion 120 in a manner that positions the outer portion 130 just outside the pinna, and the other end extending therefrom and alongside the pinna towards the user's mouth. To the one end of the outer portion 130 that is coupled to the concha portion 120 may also be coupled a support portion 140 engage a portion of the pinna as an aid to securing the in-ear audio device 100 in place relative to the user's ear during operation. Disposed on the other end of the outer portion 130 that extends towards the user's mouth is a communications microphone 160 to detect speech sounds of the user from the vicinity of the user's mouth.

The implementation of in-ear audio device 100 depicted in FIGS. 2*a* and 2*b* may be any of a variety of types of in-ear audio device able to perform two-way communications (e.g., a wireless headset or "earset" for use with a cell phone). This variant of in-ear audio device 100 may also provide ANR and/or may wirelessly receive entertainment audio from an audio device (e.g., the same cell phone used in two-way communications, or a digital audio player).

Examples of in-ear audio devices 100 disclosed herein are not limited to the form factors illustrated in FIGS. 1*a*-2*b*. Other examples of form factors for wireless headsets or earsets in which examples disclosed herein may be implemented are illustrated in FIGS. 2*c*-2*e*. In various examples, the canal portion 110 or eartip may be separable from the concha portion 120 or may include a removable covering made of, for example, soft silicone to enhance comfort for a user. For example, in the example illustrated in FIG. 2*e*, section 100A may include a rigid shell housing electronics such as an acoustic driver, wireless communication circuitry, battery, etc., while section 100B may be a removable eartip formed for a soft compliant material, for example, medical grade silicone.

Figure 3B:
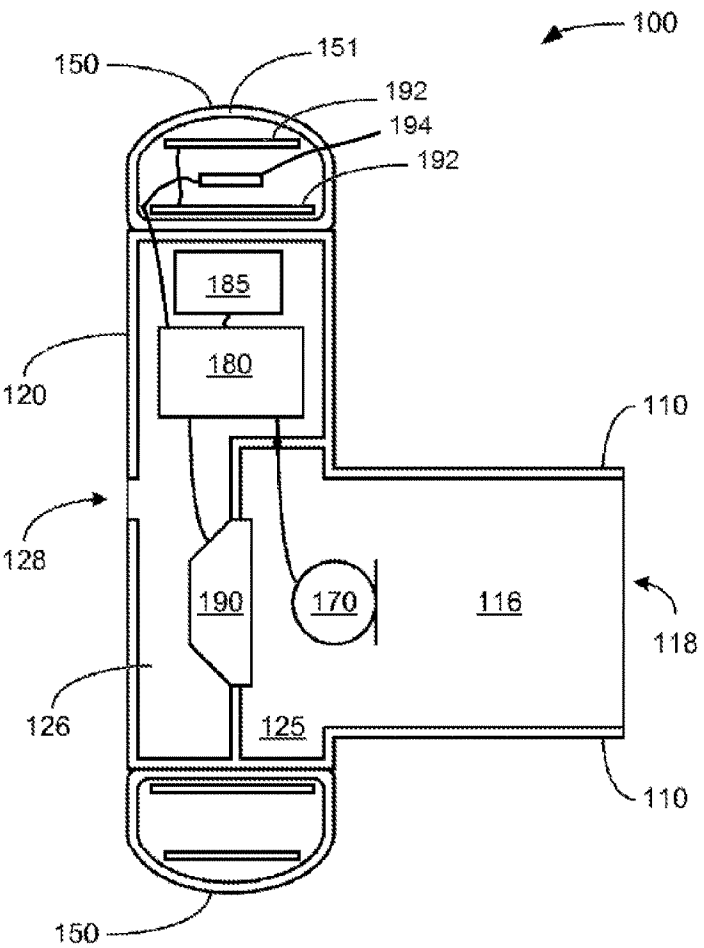
FIG. 3*b* is a partially cutaway view of another example of an in-ear audio device prepared for customization of fit into portions of a user's ear.
Figure 3A:
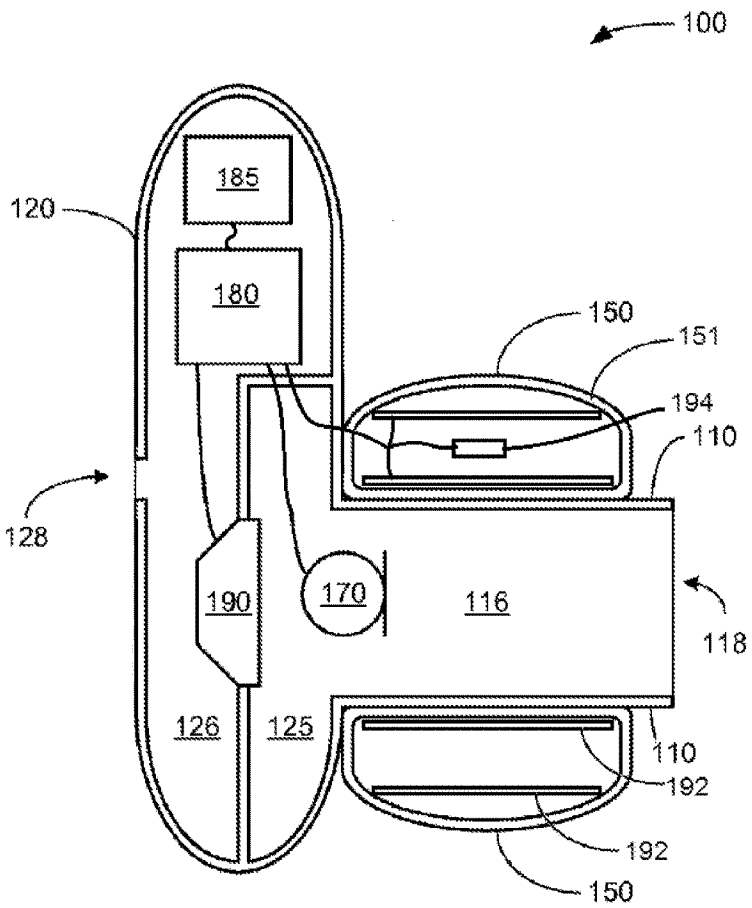
FIG. 3*a* is a partially cutaway view of the example of an in-ear audio device prepared for customization of fit into portions of a user's ear.

FIGS. 3*a* and 3*b* show partially cut-away views of two different variants of an in-ear audio device 100 at least partially prepared for customization of fit into a portion of a user's ear. More specifically, the variant depicted in FIG. 3*a* has been prepared for customization of fit into a portion of the ear canal of the user's ear, and the variant in FIG. 3*b* has been prepared for customization of fit into a portion of the concha of the user's ear. Both of these depicted variants have a physical configuration generally similar to what was depicted in FIGS. 1*a* and 1*b* with the addition of fit adjustment elements 150.

As depicted, both variants depicted in FIGS. 3*a* and 3*b* incorporate the canal portion 110 and the concha portion 120, but in some examples, one or the other of the canal portion 110 and concha portion 120 could be eliminated. Other possible variants (not depicted in cut-away views) may further include the outer portion 130. Further, both variants incorporate circuitry 180 and an acoustic driver 190 that is electrically coupled to the circuitry 180. Within the canal portion 110, a channel 116 is formed that extends from the aperture 118 through to an open interior portion 125 of the concha portion 120. Within the concha portion 120, the open interior portion 125 is separated by wall structure and the acoustic driver 190 from another open interior portion 126 in which the circuitry 180 is depicted as being disposed (though it should be noted that the circuitry 180 may be disposed in any of a variety of locations either within the casing of the in-ear audio device 100, or externally thereof). In some implementations, for example, for in-ear audio devices having wireless communications capabilities (e.g., Bluetooth® or Wi-Fi) the in-ear audio device 100 may further include a battery 185 to power the various components and wireless communication circuitry built into the circuitry 180 or a separate circuit element.

The casings of both variants further incorporate one or more fit adjustment elements or fit adjustment couplings 150 (which may alternatively be referred to as adjustable ear tips herein) which may be expanded into a portion of the user's ear as part of the process of customizing the fit into the user's ear, as will be explained in greater detail. A difference between these two depicted variants is that the variant of FIG. 3*a* has a generally annular form of one or more fit adjustment couplings 150 extending around the canal portion 110, while the variant of FIG. 3*b* has one or more fit adjustment couplings 150 extending about the concha portion 120. The fit adjustment couplings 150 may be cylindrically shaped or donut shaped. The variant of FIG. 3*a* is prepared for the fit of the canal portion 110 within the ear canal of the user's ear to be customized, while the variant of FIG. 3*b* is prepared for the fit of the concha portion 120 within the concha of the user's ear to be customized. It should be noted that these are but two examples of the manner in which the fit of variants of the in-ear audio device 100 in the ear of a user may be customized. For example, although not specifically depicted, a variant combining elements of the variants of FIGS. 3*a* and 3*b* is possible in which one or more fit adjustment couplings 150 are disposed on portions of both the canal portion 110 and the concha portion 120 to enable the fit in both the ear canal and the concha of a user's ear to be customized.

The fit adjustment couplings 150 may be formed from or include a piezoelectric material, for example, a piezoelectric polymer. As the terms are used herein, piezoelectric materials and piezoelectric polymers include electroactive polymers—polymers that exhibit a change in size or shape when stimulated by an electric field. The piezoelectric polymer expands or contacts depending on a magnitude and sign of a voltage applied across the piezoelectric polymer. Various piezoelectric polymers are known in the art and may be utilized in different implementations of the in-ear audio device 100. Non-limiting examples of piezoelectric polymers that may be utilized in the fit adjustment couplings 150 include polyvinylidenefluoride (PVDF), polyvinylidenefluoride copolymers with trifluoroethylene (TrFE) and/or tetraflouoroethylene (TFE), polyurea, polyamide (e.g., Nylon-5 or Nylon-11), or other semi-crystalline piezoelectric polymers, liquid-crystalline piezoelectric polymers, piezoelectric biopolymers (e.g., collagen, polypeptides like poly-methylglutamate and poly-benzyl-L-glutamate, oriented films of DNA, poly-lactic acid, and chitin), or amorphous piezoelectric polymers (e.g., polyacrylonitrile (PAN), poly(vinylidenecyanide vinylacetate) (PVDCN/VAc), polyphenylethernitrile (PPEN), poly(1-bicyclobutanecarbonitrile), polyvinyl chloride (PVC), and polyvinyl acetate (PVAc)). In some examples, a layer 151 of a material that is softer or more compliant than the piezoelectric material, for example, medical grade silicone, may be disposed over the piezoelectric material and may, in use, contact the ear of a user, enhancing comfort of the in-ear audio device 100.

Figure 4B:
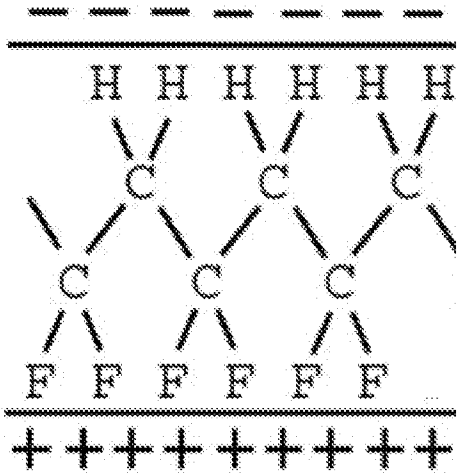
FIG. 4*b* illustrates an example of the piezoelectric material of FIG. 4*a* in an expanded state.
Figure 4A:
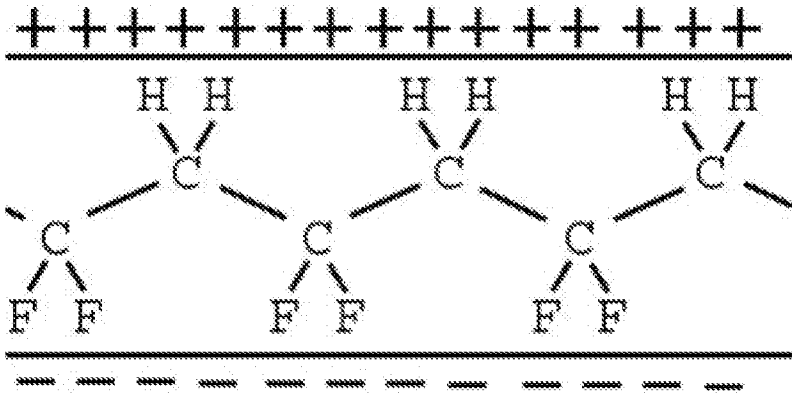
FIG. 4*a* illustrates an example of a piezoelectric material in a compressed state.

Without being bound to a particular theory, one proposed mechanism for the piezoelectric behavior of PVDF is illustrated in FIGS. 4*a* and 4*b*. PVDF is a semi-crystalline polymer formed from chains of $CH_2CF_2$. It may be produced in thin sheets that are stretched and poled to give it piezoelectric properties. The stretch direction is the direction along the sheet in which most of the carbon chains run (C's connected by lines in FIGS. 4*a* and 4*b*). The poled direction is either to the top or bottom of the sheet. The hydrogen atoms (H's in FIGS. 4*a* and 4*b*), which have a net positive charge and the fluorine atoms (F's in FIGS. 4*a* and 4*b*), which have a net negative charge end up on opposite sides of the sheet. This creates a pole direction directed to the top or bottom of the sheet. Multiple sheets may be bonded together to form a bulk piece of piezoelectric PVDF.

When an electric field is applied across the sheets they either contract in thickness and expand along the stretch direction or expand in thickness and contract along the stretch direction depending on which way the field is applied. This is due to the physical nature of the positive hydrogen atoms attracting to the negative side of the electric field and repelling from the positive side of the electric field. The negative fluorine atoms attract to the positive side of the electric field and are repelled from the negative side of the electric field. Effects of the two electric field directions on a sheet of PVDF can be seen in FIGS. 4*a* and 4*b*. In FIG. 4*a* the electric field is in the opposite direction of the poled direction and the sheet is stretched in length but compressed in thickness. In FIG. 4*b* the electric field is in the same direction of the poled direction and the sheet is contracted in length and increased in thickness.

The fit adjustment couplings 150 are connected to the battery 185 and the circuitry 180 (optionally including noise-cancelling or ANR circuitry) within implementations of the in-ear audio device 100. The fit adjustment couplings 150 are configured to expand or contract in an annular direction about the casing of the in-ear audio device 100 based on electrical voltage received from the battery and controlled by the circuitry 180. In other examples, the fit adjustment couplings 150 are alternatively or additionally configured to expand or contract into and out from the ear canal based on electrical voltage received from the battery and controlled by the circuitry 180. The voltage is delivered to electrodes 192 that may be disposed within the fit adjustment couplings 150 or at least partially outside the fit adjustment couplings 150. For example, one of the electrodes 192 may be disposed on an outer surface of the canal portion 110 and/or of the concha portion 120 and contact an inner surface of a fit adjustment coupling 150. The electrodes 192 are illustrated as being separated in an annular direction, but in other implementations, one electrode 192 may be disposed on or in a forward portion, e.g., a portion proximate the aperture 118 while the other electrode is disposed on or in a rearward portion of the fit adjustment coupling 150. In different implementations, the electrodes 192 may be constructed as conductive plates or films. The electrodes 192 may be constructed as thin metal films, conductive thread or mesh, or conductive polymer sheets and may be sufficiently flexible to deform along with the material of the fit adjustment couplings 150.

The purpose of the fit adjustment couplings 150 is to provide a configurable tip that can fit any ear canal and provide a controllable fit for achieving a steady, advantageous air leak rate. The voltage applied to the fit adjustment couplings 150 can be determined by one or more of a leak sensor and circuitry to adjust the voltage based on the rate of leak, an algorithm running on the ANR circuitry that adjusts the fit adjustment coupling 150 diameter when the ANR is struggling to compensate for the rate of change in the leak, analysis of sound emitted by acoustic driver 190 and detected by microphone 170, and/or a pressure sensor 194 within or adjacent the fit adjustment coupling 150 that is designed to maintain a consistent pressure within the ear canal and/or concha. The ANR circuitry may be utilized to provide an indication of when adjustment of the fit adjustment coupling 150 diameter may be desired by watching for an indication of an instability in the ANR feedback loop. If such an instability is detected, the ANR circuitry may provide a signal to the portion of the circuitry 180 that controls the voltage applied to the fit adjustment couplings 150 that the seal needs to be adjusted.

Pressure sensor 194 may be a piezoelectric sensor and/or may include a portion of the material of the fit adjustment coupling 150 itself. In some implementations the range of expansion of the fit adjustment couplings 150 correspond to the range of diameters of the human ear canal. Sufficient pressure from the fit adjustment couplings 150 may create enough stability that external mounts, for example, support portion 140 illustrated in FIGS. 2*a* and 2*b* could be eliminated. In some implementations the pressure applied by the fit adjustment couplings 150, and thus the tightness of the seal of the in-ear audio device 100 within a user's ear may additionally or alternatively be manually adjusted using an application running on a user's smartphone or other device that may communicate with circuitry 180.

There are two goals meant to be achieved in customizing the fit of either of these variants (or of still other variants) of the in-ear audio device 100 within an ear. First, is to provide a fit that is snug enough that the in-ear audio device 100 (whatever the variant) cannot simply fall out of a user's ear. Second, is to provide a close enough fit between a portion of the casing of the in-ear audio device 100 and a portion of a user's ear to enable a seal to be reliably formed therebetween that acoustically separates the environment within the ear canal from the external environment each time the user inserts the in-ear audio device 100 into their ear. As those skilled in the art of acoustics will readily recognize, with an entrance to the ear canal being formed of pliable skin, muscle and other tissues, the degree of sealing from the external environment actually alters the acoustic response of the ear canal to sounds acoustically output by the acoustic driver 190. Thus, it is desired to achieve a degree of fit that will enable a good degree of sealing to be achieved each time the user inserts the in-ear audio device into the ear for which the fit was customized Enabling a seal to be reliably and repeatably formed each time the user inserts the in-ear audio device 100 into their ear enables a predictable degree of quality of frequency response of the acoustic driver 190 acoustically outputting audio into the ear canal, and this enables more consistent provision of higher quality sound into the ear canal, more consistent detection of the user's voice from within the ear (in variants supporting two-way communications through detecting the user's voice through the user's ear), and more consistent provision of ANR (e.g., enabling provision of feedback-based ANR with reduced likelihood of instability). In particular, the formation of such a seal enables the acoustic driver 190 to more efficiently acoustically output lower frequency (bass) sounds, which aids both in providing higher fidelity acoustic output of entertainment and voice audio, and in providing ANR. The degree of fit of the in-ear audio device 100 may be dynamically adjusted to account for changes in the shape of a user's ear due to, for example, exercise, changes in atmospheric pressure or temperature, or other factors that may affect the size or shape of a user's ear.

Provision of the adjustable fit adjustment couplings 150 may also enable higher performance ANR. In some prior ANR systems, when an instability (or a condition that will lead to an instability) is detected, the ANR is de-tuned (e.g., run at lower performance). By adjusting the degree of fit of the in-ear audio device 100 with the fit adjustment couplings 150 instead, the ANR may be operated at higher performance while still avoiding an instability.

Both of the variants of FIGS. 3*a* and 3*b*, in being prepared for customizing the fit of each into an ear of a user, are provided with a microphone 170 that is acoustically coupled to the channel 116 for use in adjusting the customized fit. The microphone employed in customizing the fit of the variants of FIGS. 3*a* and 3*b* is a built-in microphone 170 disposed within the channel 116 and/or the open interior portion 125 and electrically coupled to the circuitry 180.

Both of the variants of FIGS. 3*a* and 3*b* are depicted as having an aperture 128 formed between the open interior portion 126 and the environment external to a user's ear. One or more of the apertures 128 may serve as acoustic ports to tune the frequency response of the acoustic driver 190 and/or may serve to enable equalization of air pressure between the ear canal and the external environment. The apertures 128 may have dimensions and/or other physical characteristics selected to acoustically couple portions within the casing of the in-ear audio device 100 to each other and/or to the external environment within a selected range of frequencies. Further, one or more damping elements (not shown) may be disposed within one or more of the apertures 128 to cooperate with characteristics of the acoustic driver 190 to alter frequency response.

Additionally or alternatively, one or more of the apertures 128 may be formed in the concha portion 120 (and/or in other portions of the casing) to provide a controlled acoustic leak between the ear canal and the external environmental for purposes of controlling the effects of variations in fit that may develop over time after customization has been performed and an initial fit bringing about a desired quality of acoustic response has been achieved. As will be recognized by those skilled in the art, variations in the health or other aspects of the physical condition of a user can bring about minor alterations in the dimensions and/or shape of the ear canal over time such that the quality of the seal able to be formed with each insertion of the in-ear audio device 100 into the ear over time may degrade. Thus, in some implementations, the dimensions and/or other characteristics of one or more apertures 128 formed in the casing may be selected to aid in mitigating the effects of a slightly degraded quality of seal by providing a pre-existing leak of controlled characteristics that mitigates the acoustic effects of other leaks developing in the future in the seal between the casing of the in-ear audio device 100 and portions of the ear. For example, the dimensions of one or more apertures 128 may be selected to be large enough to provide a far greater coupling between the ear canal and the external environment than any other coupling through a leak in the seal that may develop at a later time. In other implementations the fit adjustment couplings 150 may be utilized to control leakage between the ear canal and the external environment and apertures 128 may be omitted.

Figure 3D:
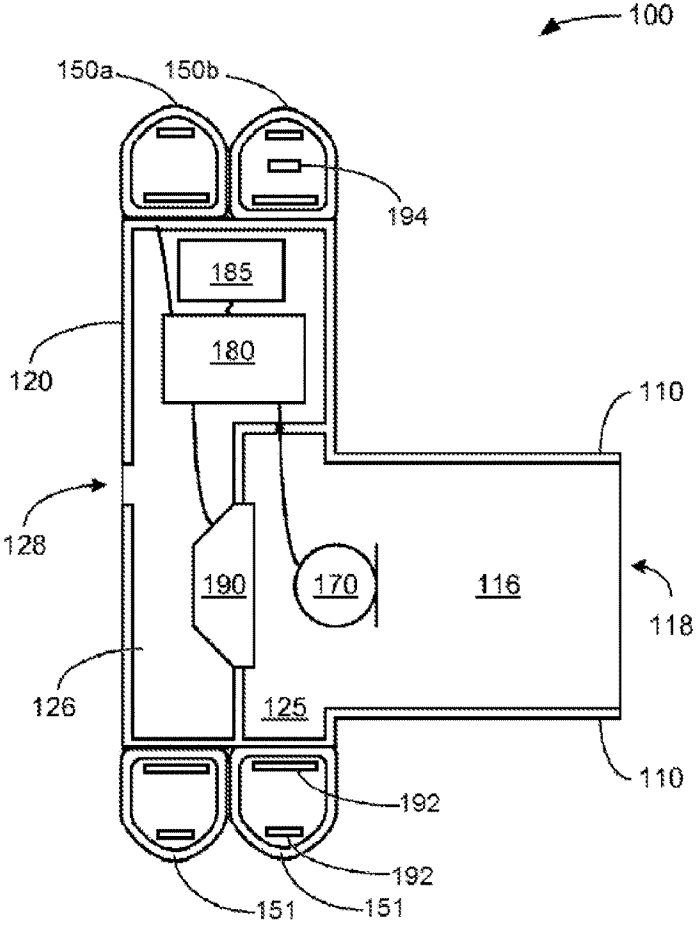
FIG. 3*d* is a partially cutaway view of another example of an in-ear audio device prepared for customization of fit into portions of a user's ear.
Figure 3C:
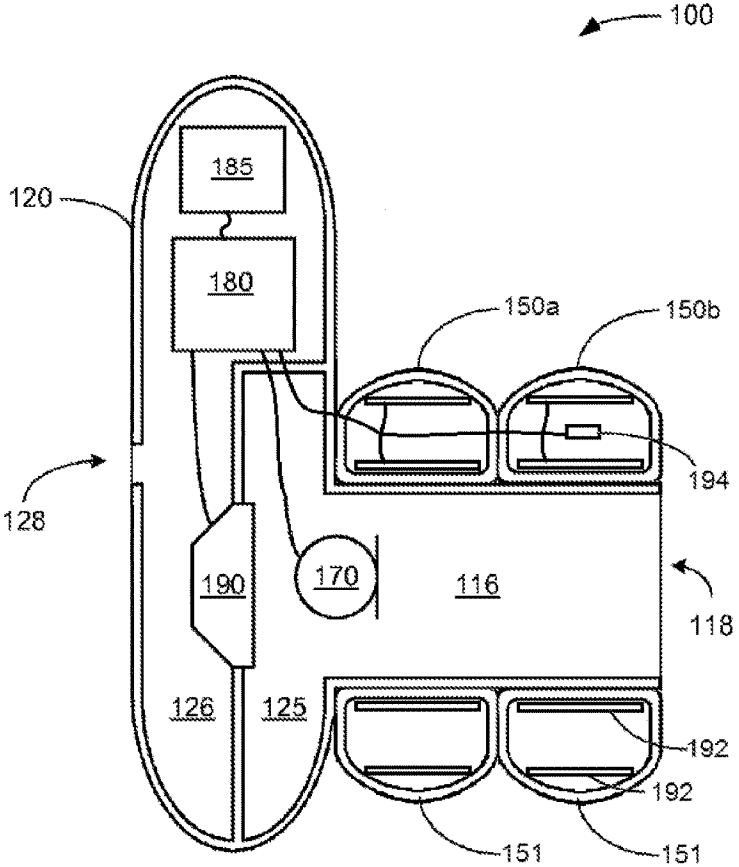
FIG. 3*c* is a partially cutaway view of another example of an in-ear audio device prepared for customization of fit into portions of a user's ear.

In alternate implementations, illustrated in FIGS. 3*c* and 3*d*, a pair of piezoelectric fit adjustment couplings 150*a*, 150*b* are disposed extending around the canal portion 110 and about the concha portion 120, respectively, of examples of in-ear audio devices 100. The two piezoelectric fit adjustment couplings 150*a*, 150*b* are arranged in series but closely spaced apart or contacting one another. The two-piezoelectric fit adjustment coupling implementation allows for a coarse seal adjustment and a fine seal adjustment. One of the piezoelectric fit adjustment couplings 150*a*, 150*b* provides for a coarse seal and the other of the piezoelectric fit adjustment couplings 150*a*, 150*b* provides for a fine seal. The two piezoelectric fit adjustment couplings 150*a*, 150*b* may be formed from or include different electroactive polymers and/or be differently dimensioned to allow for a wider range of expansion (i.e., greater force on the ear canal and/or concha) in the coarse piezoelectric fit adjustment coupling and a smaller range of expansion in the fine piezoelectric fit adjustment coupling (i.e., less force on the ear canal and/or concha). By utilizing two seals, the ANR circuit will be able to make smaller adjustments in the fine piezoelectric fit adjustment coupling since the coarse piezoelectric fit adjustment coupling should provide a roughly effective seal, while the smaller fine adjustment piezoelectric fit adjustment coupling can make minor changes to perfect the rate of leak allowed by the dual seal.

In alternate implementations, a respective pair of piezoelectric fit adjustment couplings 150*a*, 150*b* (four fit adjustment couplings total) may be disposed extending around both the canal portion 110 and about the concha portion 120. In further implementations, a pair of piezoelectric fit adjustment couplings 150*a*, 150*b* are disposed extending around one of the canal portion 110 or about the concha portion 120 and a single piezoelectric fit adjustment coupling is disposed extending around the other of the canal portion 110 or concha portion 120. In other implementations more than two fit adjustment couplings may be disposed about the canal portion 110 and/or about the concha portion 120.

Figure 3E:
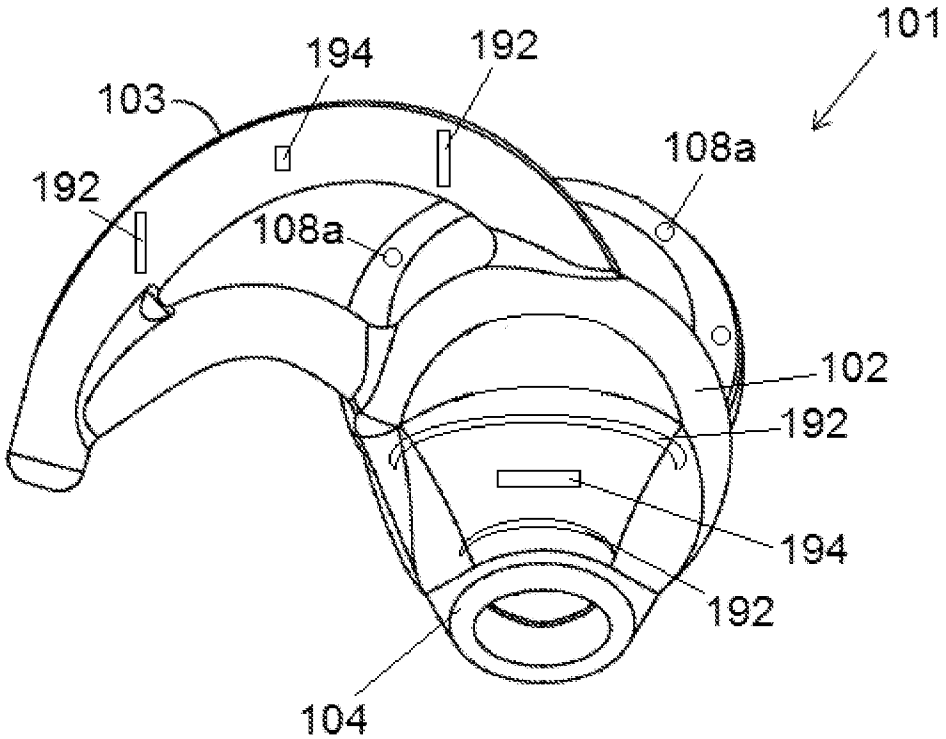
FIG. 3*e* is an example of an eartip including portions with adjustable shapes.
Figure 3F:
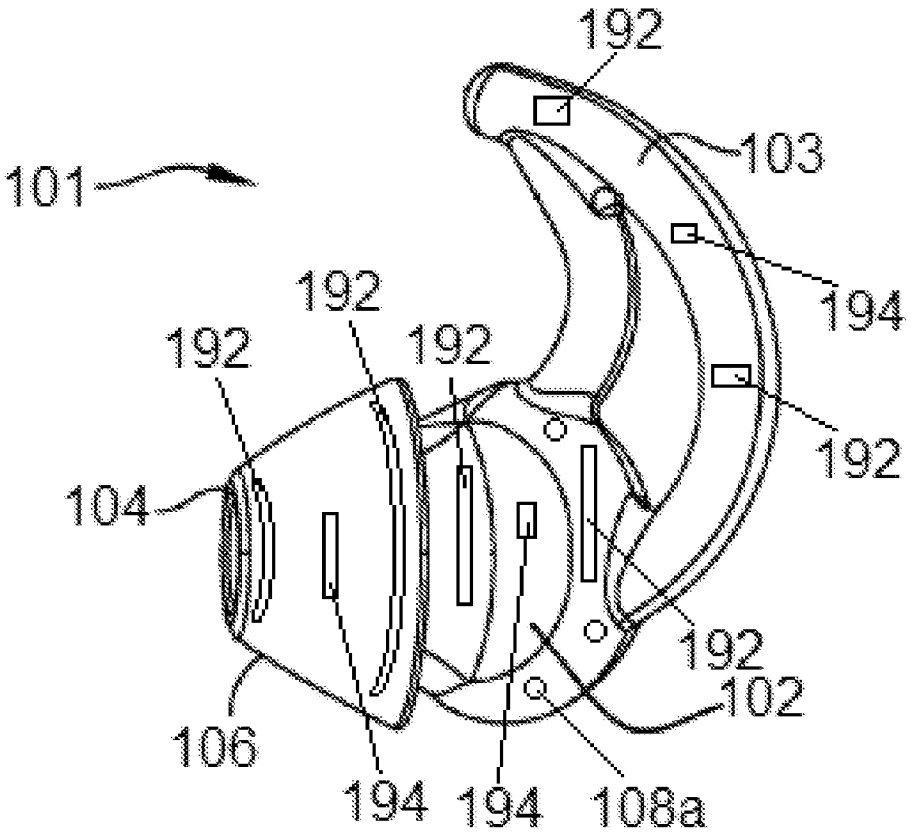
FIG. 3*f* is another example of an eartip including portions with adjustable shapes.
Figure 3G:
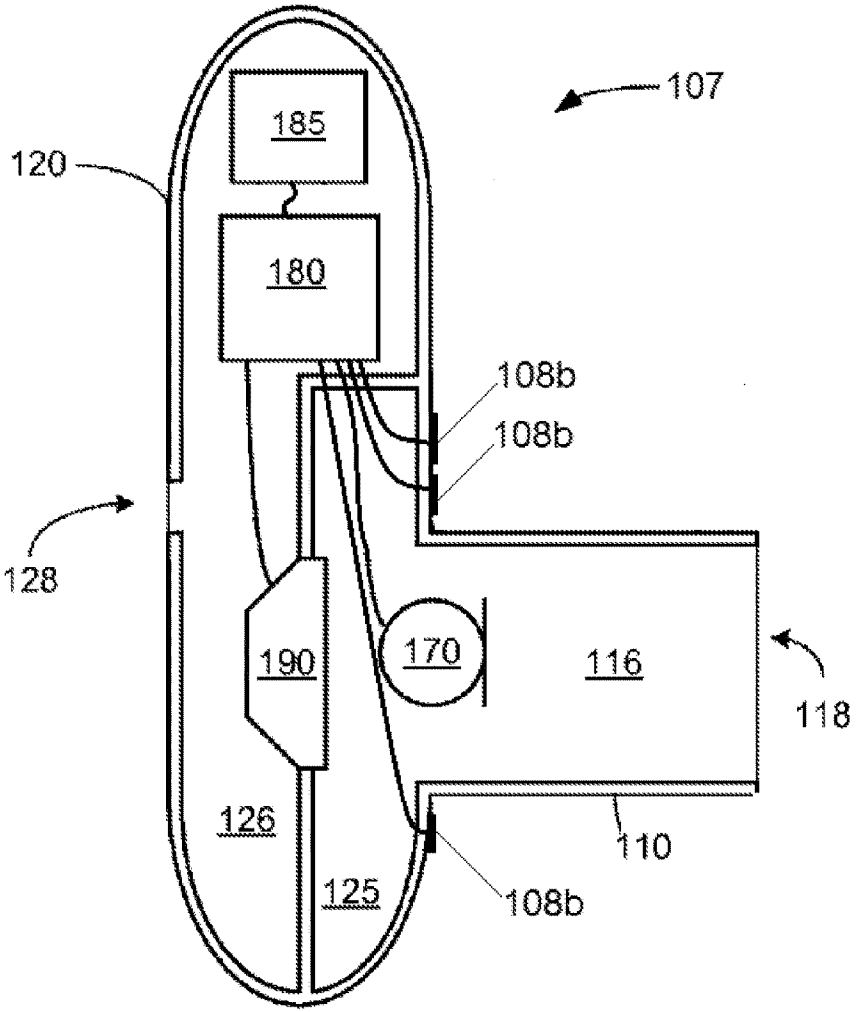
FIG. 3*g* is an example of an audio device that may be utilized with the eartips of FIG. 3*e* or 3*f;*

In further implementations piezoelectric fit adjustment couplings may be incorporated into removable ear tips for an in-ear audio device 100. Examples of removable ear tips are illustrated in FIGS. 3*e* and 3*f*, indicated generally at 101. These ear tips 101 have a configuration that includes a body 102 that rests in the concha, a retaining leg 103 that rests against and applies pressure to the antihelix, and an outlet 104 that fits within at least an entrance in the ear canal. The ear tip 101 illustrated in FIG. 3*f* further includes a flexible flap 106 around the outlet. The construction and configuration of the removable ear tips 101 illustrated in FIGS. 3*e* and 3*f* are described in further detail in commonly owned U.S. Pat. Nos. 8,311,253 and 8,737,669, which are incorporated by reference in their entirety herein. In these ear tips, piezeoelectric material may be included in the retaining leg 103, body 102, outlet 104 and/or flap 106 with adjustments made to improve seal and/or fit accordingly. Electrodes 192 and optionally pressure sensors 194 may be embedded in the piezoelectric material in eartips 101 in a similar manner as in the examples illustrated in FIGS. 3*a*-3*d*. Power and electrical communication may be provided to the electrodes 192 and optional pressure sensors 194 in eartips 101 from a device 107, for example, as illustrated in FIG. 3*e* (illustrated as similar to a portion of the in-ear audio device of FIG. 3*a* with similar elements represented by similar reference numbers) upon which the eartips 101 are mounted during use via electrical couplings 108*a* on the eartips 101 and complimentary electrical couplings 108*b* on the device 107. Electrical couplings 108*a*, 108*b* may include inductive coils or may be configured to make physical contact with each other.

Figure 5:
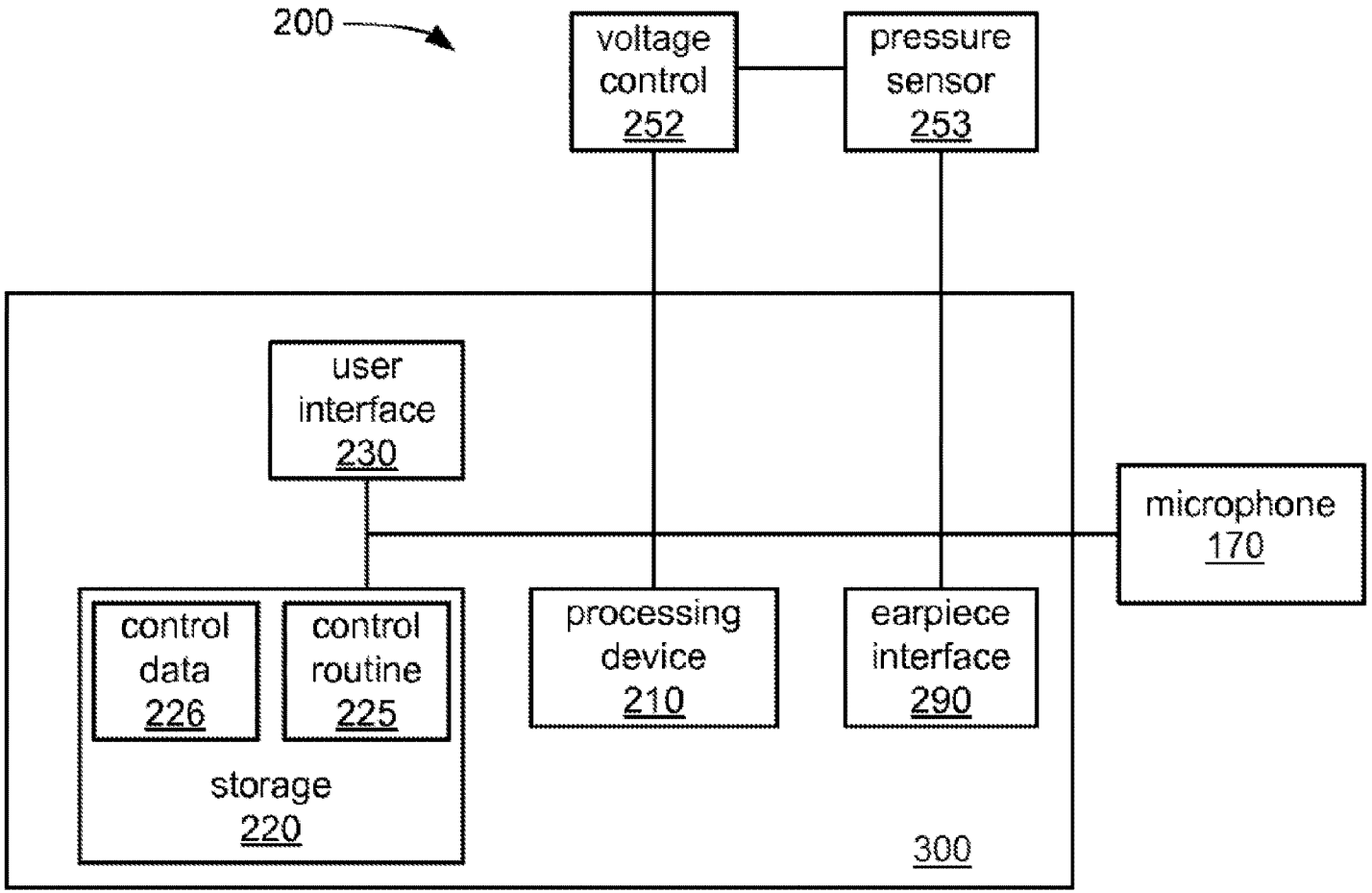
FIG. 5 is block diagram of a customization system usable with any of the examples or variants of examples of in-ear audio device depicted in any of the above figures.
Figure 6:
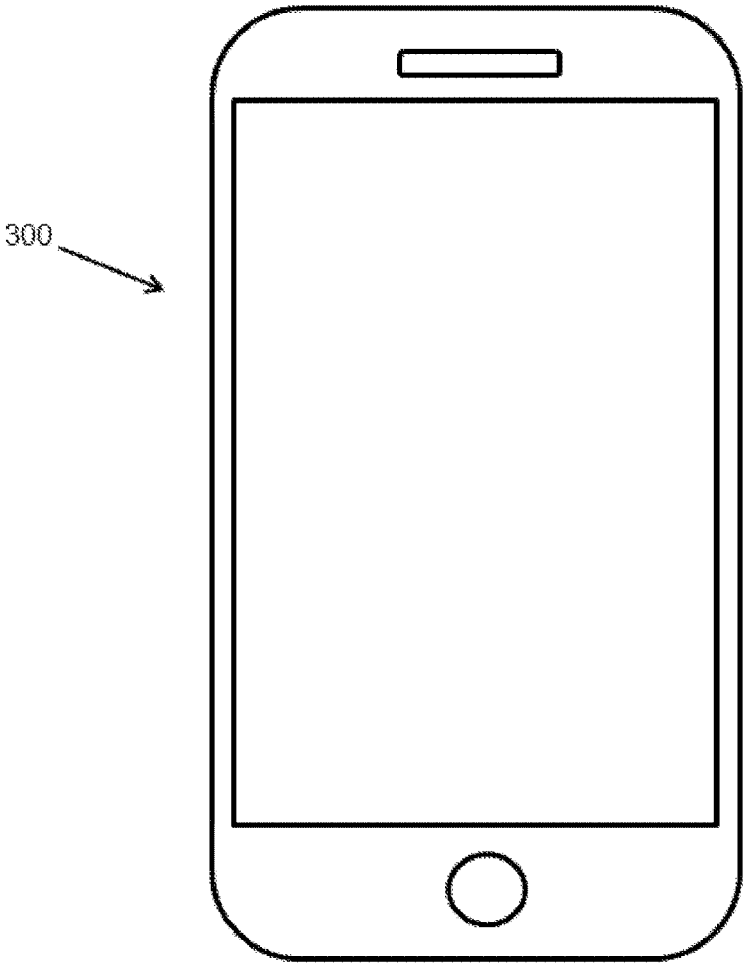
FIG. 6 illustrates a controller for the customization system of FIG. 5.

FIG. 5 provides a block diagram of a customizing system 200 by which the process of customizing the fit of the in-ear audio device 100 within an ear of a user may be performed and controlled. The customizing system 200 may be operated by an operator with some amount of training in aspects of customizing the fit of the in-ear audio device 100, for example, a nurse or other type of technician at a clinic. However, the customizing system 200 may also be operable by a would-be user of the in-ear audio device 100 to customize the fit within one of their own ears. In other implementations fit adjustment could be performed by the system automatically when the ear buds are placed into the user's ear canal.

The customizing system 200 may be implemented as an application on a smartphone 300 (FIG. 5) or other mobile computing device or other form of computer system (e.g., a laptop or desktop). In other implementations a smartphone 300 or other mobile computing device or other form of computer system may be utilized as a user interface (e.g., user interface 230) for a separate dedicated customizing system 200.

The customizing system 200 incorporates a voltage control 252 to controllably provide a voltage to one or more piezoelectric fit adjustment couplings formed on the canal portion 110 and/or the concha portion 120 of the casing of an in-ear audio device 100 via the circuitry 180. The customizing system 200 may optionally include a pressure sensor 253, which may be the same or a different pressure sensor from sensor 194. The customizing system 200 also incorporates a user interface 230 including one or more audible and/or visible indicators (e.g., buzzers, status lights, LCD display, etc.) and manually-operable controls (e.g., manually-operable switches, keyboard, etc.) to allow manual control of at least some aspects of customization of fit, a storage 220 in which is stored a control routine 225, and a processing device 210 coupled to the storage 220 to access and execute a sequence of instructions of the control routine 225. The processing device 210 is also coupled to the voltage control 252 to operate the voltage control 252 to effect the application of a controlled voltage to one or more of the piezoelectric fit adjustment couplings via circuitry 180, and is further coupled to the pressure sensor 253 (when present) to monitor the pressure created in or by the piezoelectric fit adjustment couplings during customization. The customizing system 200 also incorporates at least an earpiece interface 290 to enable coupling of the customization system 200 (with either a wired or wireless coupling) to the circuitry 180 of the in-ear audio device 100 to cause the acoustic driver 190 to be driven to acoustically output various test sounds during customization and/or to monitor signals produced by the pressure sensor 194. The customizing system 200 may further incorporate the built-in microphone 170 in variants of the in-ear audio device 100 that incorporate the built-in microphone 170. Where the built-in microphone 170 is employed by the customizing system 200, the earpiece interface 290 may be further employed to use its coupling to the circuitry 180 to enable monitoring of the built-in microphone 170.

An implementation of performing a customization of fit entails inserting one of the in-ear audio devices 100 with one or more of the piezoelectric fit adjustment couplings initially in a relaxed or compressed state into an ear of a would-be user of the in-ear audio device 100, and then expanding the piezoelectric fit adjustment coupling(s) by the application of a slowly increasing voltage across the electrodes 192 while the acoustic driver 190 is driven to acoustically output various test sounds (either continuously or at intervals), while the built-in microphone 170 is used to monitor the acoustic results of the acoustic output of those test sounds, and/or while the pressure sensor 253 is monitored to expand the one or more piezoelectric fit adjustment couplings to a point at which a pressure applied to the user's ear canal is within an expected or desired range. The voltage increase continues until the microphone detects sounds with characteristics indicating a desired degree of sealing has been achieved, until the would-be user indicates (for example, through the user interface 230) that the fit resulting from the expansion of the one or more piezoelectric fit adjustment couplings is becoming uncomfortable, or until the pressure sensor 253 detects a pressure outside a predetermined range of pressures that are expected to be encountered during customization. After the expansion of the one or more piezoelectric fit adjustment couplings is done the applied voltage may be decreased by a predetermined amount to achieve a degree of expansion of the one or more piezoelectric fit adjustment couplings that is found to provide the desired degree of sealing. The applied voltage is then maintained by the circuitry 180 so that the one or more piezoelectric fit adjustment couplings permanently hold a shape that is customized to the user's ear. The magnitude of the applied voltage (or voltages in implementations including multiple piezoelectric fit adjustment couplings) may be stored in a memory of the in-ear audio device 100 (for example, in circuitry 180) and/or customizing system 200 so that a similar customization may be performed for subsequent uses of the in-ear audio device 100 by the user. In other implementations, the customization process could be dynamic and thus always changing depending on the signals received by the system.

Turning to some of the internal details of carrying out customization, it is through accessing the storage 220 to retrieve and execute a sequence of instructions of the control routine 225 that the processing device 210 is caused to control customization. First, the processing device 210 awaits input via the user interface 230 that the in-ear audio device 100 has been properly positioned within an ear of the would-be user such that customization can be performed. This user input can be manually entered, or can be automatic once the in-ear audio device 100 has been positioned within an ear. The processing device 210 then operates the earpiece interface 290 to convey test sounds to the circuitry 180 of the in-ear audio device 100 to cause the acoustic driver 190 therein to output test sounds. The processing device 210 also operates the earpiece interface 290 to monitor the built-in microphone 170 through the circuitry 180 to monitor the acoustic results of the acoustic output of the test sounds by the acoustic driver 190. While causing the test sounds to be acoustically output and monitoring the results of doing so, the processing device 210 further operates the voltage control 252 and circuitry 180 to begin expansion of the one or more piezoelectric fit adjustment couplings of the in-ear audio device 100 via application of voltage across the electrodes 192. The processing device 210 additionally or alternatively monitors the pressure sensor 253 for indications of a pressure level outside a range of pressures expected to be detected during customization.

In some implementations, the processing device 210 is caused by execution of the control routine 255 to continue causing the acoustic output of test sounds, continue monitoring the acoustic results through the microphone 170, and continue expansion of the one or more piezoelectric fit adjustment couplings until the characteristics of the sounds detected by the microphone 170 indicate that a seal has been achieved between the in-ear audio device 100 and the ear and the ear canal is sufficiently acoustically separated from the external environment that a desired quality of acoustic response to the acoustic output of the acoustic driver 190 has been achieved. In general, the frequency/acoustic response (including phase, magnitude, or both) for a transfer function defined by an acoustic path from the acoustic driver 190 to the microphone 170 may be monitored to determine sufficiency of the seal. In some examples, using the phase of the frequency response to determine sufficiency of seal permits the use of higher frequency test sounds, which are less susceptible to background or other noise in the environment. Upon receiving an indication that a desired quality of acoustic response has been achieved, the processing device 210 operates the voltage control 252 to cease expansion of the one or more piezoelectric fit adjustment couplings. In other implementations, the processing device 210 additionally or alternatively operates the voltage control 252 to cease expansion of the one or more piezoelectric fit adjustment couplings until it receives an indication from the pressure sensor 253, 194 that the pressure applied by the one or more piezoelectric fit adjustment couplings to the ear canal and/or concha of the user has reached a desired level or is within a desired range. Alternatively, the processing device 210 additionally or alternatively operates the voltage control 252 to cease expansion of the one or more piezoelectric fit adjustment couplings until it receives an indication from the user interface 230 that the pressure applied by the one or more piezoelectric fit adjustment couplings has become uncomfortable for a user.

The customizing of fit may be carried out under the control of the processing device 210 as directed through its execution of the control routine 225, while providing a visual, audio, or other indication through the user interface 230 of conditions during and/or following customization, for example, to enable "fine tuning" of the fit by an operator. More specifically, the user interface 230 may be operable by the processing device to provide an operator with a visual display or other indication of the selection of test sounds being employed by the processing device 210, the frequency response of the ear canal to the acoustic output of those test sounds by the acoustic driver 190 of the in-ear audio device 100, and/or of the pressure measured by the pressure sensor 253, 194. The provision of such information may enable an operator to guide the choice of test sounds and/or the pressure at which expansion of the one or more piezoelectric fit adjustment couplings is done and/or rate of expansion of the one or more piezoelectric fit adjustment couplings. The processing device 210 may access control data 226 stored in the storage 220 to obtain data concerning frequency response characteristics of known instances of a good seal resulting in a desirable degree of frequency response being achieved as a reference against which to compare frequency response characteristics observed during a current customization. The control data 226 may further include statistical and/or predictive analysis algorithms to be employed by the processing device 210 in iterating through testing differing degrees of expansion of the one or more piezoelectric fit adjustment couplings with different test sounds as part of achieving a degree of expansion of the one or more piezoelectric fit adjustment couplings that achieves a fit that enables a desired quality of frequency response.

During expansion of the one or more piezoelectric fit adjustment couplings the pressure sensor 253, 194 (where present) monitors pressure in or exerted by the piezoelectric fit adjustment couplings to provide an indication of whether the pressure is either lower than expected or higher than expected. An unexpected pressure reading may be an indication of damage to the one or more piezoelectric fit adjustment couplings. A maximum pressure level may also be selected that the processing device 210 does not allow to be exceeded as a safety feature to avoid injury to would-be users. In response to the detection of a level of pressure outside the expected range, the processing device 210 may be caused by the control routine 225 to immediately operate the voltage control 252 to cease increasing voltage applied across the electrodes 192, and may further operate the voltage control 252 to at least partially decrease the magnitude of voltage applied across the electrodes 192. Further, the user interface 130 may be operable by the processing device 210 to provide a visual or audible alert of the anomalous pressure level that has been detected.

In some implementations, the customization may be completed automatically without the user interface 230 needing to be operated by someone to manually intercede in the customizing, for example, the would-be user indicating that the one or more piezoelectric fit adjustment couplings have been expanded to a point that the fit is uncomfortable. However, with the high degree of variability in physiology of ears between different people, it may be that a particular would-be user of the in-ear audio device 100 is too sensitive to the sensation of having the one or more piezoelectric fit adjustment couplings being expanded to the extent that enough of a seal is created that the desired quality of frequency response is achieved, and thus, a somewhat lesser quality of frequency response may have to be accepted. To accommodate this possibility, the user interface 230 may include a manually-operable control that is provided to the would-be user of the in-ear audio device 100 during customization that allows them to immediately stop the expansion of the one or more piezoelectric fit adjustment couplings upon beginning to feel discomfort. The user interface 230 may be operable by the processing device 210 to provide a visual display of aspects of the frequency response achieved thus far in the customization to allow an operator of the customizing system 200 to determine if a less than desired quality of frequency response is still good enough. Yet further, the user interface 130 may be operable to provide a visual display of the pressure applied to the user's ear canal and/or concha, which may provide some insight to an operator of the customizing system 200 as to whether enough of a snug fit has yet been achieved to prevent the in-ear audio device 100 from falling out of the would-be user's ear. Moreover, the user interface 230 may display characteristics about the quality of the seal achieved with the current configuration of the in-ear audio device 100. For example, qualitative descriptions of the seal (e.g., "excellent seal," "adequate seal," "poor seal," etc.) or quantitative descriptions (e.g., percentage seal, corresponding performance of ANR system, etc.) of the seal could be displayed.

In some implementations, the test sounds are made up of a wide range of frequencies of human audible sounds (e.g., 20 Hz to 20 KHz). Such a wide range of frequencies may be covered with an acoustic output of sounds that sweep continuously from one end of the range of frequencies to another, or that step through a number of distinct frequencies selected throughout the range of frequencies, or in some other manner Such a wide spectrum of frequencies may be further employed to develop an equalization curve to be programmed into the circuitry 180 to further enhance the quality of sound experienced by the would-be user as they listen to audio output by the acoustic driver 190 during normal use of the in-ear audio device 100 after customization has been done. Alternatively or additionally, such an equalization curve may be programmed into an audio source device (e.g., a radio) that provides audio to the circuitry 180 for being acoustically output by the acoustic driver 190. Indeed, where a broad range of frequencies of sounds is to be used, a piece of music with the desired range of frequencies of sounds may be used.

Alternatively, in other implementations, the test sounds are made up of lower frequency sounds (e.g., approximately 50-300 Hz) or even inaudible sounds in the subsonic or infrasonic range. Such frequencies may be chosen to correspond to dimensions and/or other physical characteristics that are selected and given to one or more of the apertures 128 (however many there may be in a given implementation) to acoustically couple the ear canal to the external environment within those lower frequencies, possibly to enhance the effectiveness of those test sounds in evaluating frequency response. However, such lower frequency sounds may still be supplemented with a range of higher frequency sounds employed to test for possible acoustic resonances within an ear canal.

In some implementations, the casing of the in-ear audio device 100 may be separable into multiple pieces, either to allow for greater flexibility in customization or to allow a previously customized portion of the casing of one in-ear audio device 100 to be separated and used with another. For example, there may be a selection of canal portions 110 from which a particular canal portion 100 may be selected to accommodate a particular size of ear canal of a particular would-be user. Correspondingly, there may be a selection of concha portions 120 from which a particular concha portion 120 may be selected to accommodate a particular size of concha of a particular would-be user. Also for example, either a single piezoelectric fit adjustment coupling or a set of the piezoelectric fit adjustment couplings may be separable from other casing portions to enable their reuse with other casing portions of a replacement or upgraded form of in-ear audio device 100 (for example, a newer version that adds ANR, has a higher quality acoustic driver, or provides some other audio feature) to allow a fit previously achieved using that one or more piezoelectric fit adjustment couplings to be carried over as a user of one in-ear audio device 100 makes a switch to another one.

Indeed, a mixing and matching of different casing portions may precede the customization of fit as a way of first achieving a "rough" fit before employing one or more of the piezoelectric fit adjustment couplings in customization to achieve a still better fit. The use of different ones of a selection of the canal portion 110 and/or the concha portion 120 (and/or still other casing portions) can change the test sounds that are best used and/or the characteristics of the frequency response sought to be achieved during customization. For example, different sizes of the canal portion 110 can bring about different lengths and/or diameters of the channel 116 and/or different dimensions of the aperture 118 into the ear canal such that the acoustics of the canal portion 110 are sufficiently different among different sizes of the canal portion 110 that a single set of test sounds are not effective for use among all of the different sizes.

In some implementations a memory device or other type of data storage is carried within the in-ear audio device 100 (for example, within the circuitry 180) that stores information concerning its customization for a particular user, such as characteristics of the test sounds used (e.g., types of sounds, frequencies used), characteristics of voltage v. pressure curve(s) of the piezoelectric fit adjustment couplings, characteristics of one or more portions of the casing (e.g., dimensions of one or the other of the canal portion 110 and concha portion 120), or parameters utilized in previous customizations (for example, voltages applied across the electrodes to achieve a desirable fit). This may be of use in speeding subsequent customizations of the same or future in-ear audio devices 100 for use by the same user, perhaps avoiding the need to again deduce what sizes of casing portions should be selected or what test sounds are best used for a particular ear. Such information may additionally or alternatively be maintained by the customizing system 200 and/or a server (not shown) that may store sets of such information over time as new customizations for a particular user are done—perhaps enabling trends concerning characteristics of a particular user's ear(s) to be derived that may be useful to future customizations.

In yet other alternative implementations, it may be that no microphone is employed in monitoring the acoustic results of the acoustic output of test sounds to determine when a desired quality of frequency response has been achieved. Instead, the impedance and/or other characteristics of the acoustic driver 190, itself, may be monitored to detect an instance of the acoustic driver 190 having an impedance or other characteristic during acoustic output of a sound of a known frequency that is indicative of a desirable quality of frequency response (and fit of the in-ear audio device) being achieved.

Figure 7:
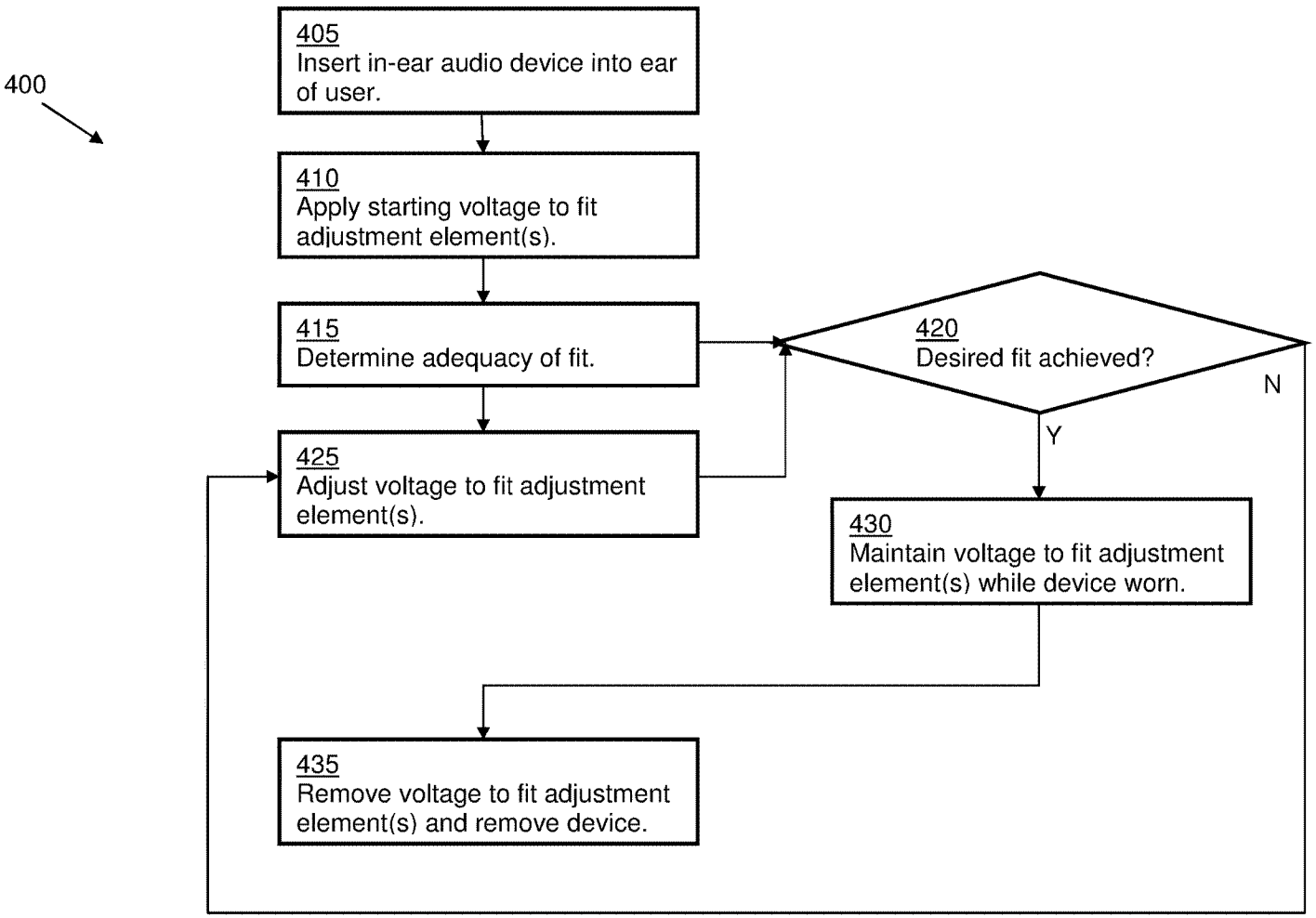
FIG. 7 is a flow chart of a method for a user to adjust the seal of examples of in-ear audio devices disclosed herein.

In some implementations, a method of customizing fit of an in-ear audio device 100 including one or more piezoelectric fit adjustment couplings may be carried out in accordance with the flowchart illustrated in FIG. 7, generally at 400. In act 405, the in-ear audio device 100 is inserted into the ear of a user with the piezoelectric fit adjustment coupling(s) in a compressed or relaxed state. In act 410 a first voltage is applied across the electrodes of the coarse piezoelectric fit adjustment coupling and a second voltage is applied across the electrodes of the fine piezoelectric fit adjustment coupling. In examples in which the in-ear audio device 100 includes only a single piezoelectric fit adjustment coupling, act 410 involves applying a first voltage across the electrodes of the single piezoelectric fit adjustment coupling. The first voltage (or first and second voltages in examples with both a coarse piezoelectric fit adjustment coupling and a fine piezoelectric fit adjustment coupling) is selected such that the piezoelectric fit adjustment coupling (or couplings) expand and apply a pressure to the user's ear canal and/or concha that is expected to be less than necessary to form a complete seal and that is safe for the user. In act 415 an adequacy of fit of the in-ear audio device in the ear of the user is determined, for example, by determining a degree of air leak out of the user's ear and/or by monitoring the frequency response of the ear canal to the acoustic output of test sounds produced by the acoustic driver 190 of the in-ear audio device 100, and/or by checking the pressure measured by the pressure sensor 253, 194 and/or by receiving feedback from the user as described above. If the fit of the in-ear audio device in the ear of the user is determined to be adequate (act 420), the voltage (or voltages) across the electrodes of the piezoelectric fit adjustment coupling (or couplings) is (or are) maintained while the user wears the in-ear audio device (act 430). If the fit of the in-ear audio device in the ear of the user is determined to be inadequate or undesirable (act 420), the voltage (or voltages) across the electrodes of the piezoelectric fit adjustment coupling (or across the electrodes of the coarse and/or fine piezoelectric fit adjustment couplings) are adjusted (act 425). In examples in which the in-ear audio device 100 includes both coarse and fine piezoelectric fit adjustment couplings, if the fit is determined to be far from what is desired or if the voltage applied to the fine piezoelectric fit adjustment is at a maximum permissible voltage, the magnitude of the voltage across the coarse piezoelectric fit adjustment coupling is increased. If, however, only fine adjustments are desired, the voltage across the electrodes of the fine piezoelectric fit adjustment coupling is adjusted. After adjustment of the voltage (or voltages) across the electrodes of the piezoelectric fit adjustment coupling (or couplings) is performed, the adequacy of fit of the in-ear audio device is again checked (act 420). Acts 420 and 425 are repeated until a desired fit is achieved. When the user decides to remove the in-ear audio device, the provision of voltage across the electrodes of the piezoelectric fit adjustment coupling (or couplings) is terminated, allowing the piezoelectric fit adjustment coupling (or couplings) to return to a relaxed or compressed state so the in-ear audio device may be easily removed from the ear of the user (act 435).

Having thus described several aspects of at least one implementation, it is to be appreciated various alterations, modifications, and improvements will readily occur to those skilled in the art. Such alterations, modifications, and improvements are intended to be part of this disclosure, and are intended to be within the spirit and scope of the disclosure. The acts of methods disclosed herein may be performed in alternate orders than illustrated, and one or more acts may be omitted, substituted, or added. One or more features of any one example disclosed herein may be combined with or substituted for one or more features of any other example disclosed. Accordingly, the foregoing description and drawings are by way of example only.

The phraseology and terminology used herein is for the purpose of description and should not be regarded as limiting. As used herein, the term "plurality" refers to two or more items or components. As used herein, dimensions which are described as being "substantially similar" should be considered to be within about 25% of one another. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A method of customizing the fit of a portion of an in-ear audio device within a portion of an ear, the method comprising:

determining a degree of sealing between the in-ear audio device and the portion of the ear; and applying a voltage to at least a portion of an ear tip formed at least partially of a piezoelectric material and attached to the in-ear audio device to selectively expand or contract the portion of the ear tip based on the determination until the degree of sealing between the in-ear audio device and the portion of the ear achieves a desired degree of sealing.

2. The method of claim 1, wherein determining a degree of sealing between the in-ear audio device and the portion of the ear comprises:

driving an acoustic driver of the in-ear audio device to acoustically output a test sound into an ear canal of the ear; and monitoring a microphone that is acoustically coupled to the ear canal to detect sounds within the ear canal that are indicative of the frequency response of the acoustic driver acoustically outputting the test sound into the ear canal.

3. The method of claim 2, further comprising applying the voltage to at least a portion of the ear tip while the acoustic driver is driven to acoustically output the test sound and the microphone is monitored.

4. The method of claim 2, further comprising:

employing the sounds detected by the microphone that are indicative of the frequency response of the acoustic driver acoustically outputting the test sound into the ear canal to determine if the degree of sealing between the in-ear audio device and the portion of the ear achieves a desired quality of frequency response of the acoustic driver acoustically outputting the test sound.

5. The method of claim 2, wherein monitoring the microphone comprises monitoring a built-in microphone disposed within a casing of the in-ear audio device.

6. The method of claim 1, wherein the voltage is applied to the piezoelectric material within the ear tip, and the piezoelectric material expands or contracts based on the applied voltage.

7. The method of claim 6, wherein the piezoelectric material is disposed within an ear canal portion of the ear tip of the in-ear audio device.

8. The method of claim 6, wherein the piezoelectric material is disposed within a concha portion of the ear tip of the in-ear audio device.

9. The method of claim 1, further comprising:

monitoring a pressure exerted by the in-ear audio device coupling to the portion of the ear; and ceasing application of the voltage to at least the portion of the ear tip in response to the level of pressure being outside a predetermined range of pressure levels.

10. The method of claim 1, further comprising:

monitoring a manually-operable control for an indication of the degree of sealing due to applying the voltage causing discomfort to a user of the in-ear audio device; and ceasing application of the voltage to at least the portion of the ear tip in response to the indication.

11. An in-ear audio device comprising: an ear tip comprising: an ear canal portion configured to be inserted into at least an entrance of an ear canal of a user; and a concha portion configured to be inserted into at least a concha of the ear of the user, wherein at least one of the ear canal portion and the concha portion comprise a piezoelectric material; and a processing device configured to determine a degree of sealing between the ear tip and a portion of the user's ear and apply a voltage to the piezoelectric material to selectively expand or contract the piezoelectric material based on the determination until the degree of sealing between the ear tip and the portion of the user's ear achieves a desired degree of sealing.

12. The in-ear audio device of claim 11, wherein the ear canal portion comprises an outlet with an opening therein for directing sound from an acoustic driver towards the ear canal of the user.

13. The in-ear audio device of claim 12, wherein the ear canal portion further comprises a flexible flap surrounding at least a portion of the outlet.

14. The in-ear audio device of claim 13, wherein the piezoelectric material is disposed within the flap of the ear canal portion of the in-ear audio device.

15. The in-ear audio device of claim 12, wherein the piezoelectric material is disposed within the outlet of the ear canal portion of the in-ear audio device.

16. The in-ear audio device of claim 12, wherein the at least one of the ear canal portion and the concha portion that comprises a piezoelectric material further comprises silicone material, wherein the silicone material is disposed at an exterior surface of the ear canal portion or concha portion.

17. The in-ear audio device of claim 11, further comprising an acoustic driver for acoustically outputting a test sound into the ear canal of the ear.

18. The in-ear audio device of claim 17, further comprising an interior microphone that is acoustically coupled to the ear canal to detect sounds within the ear canal that are indicative of the frequency response of the acoustic driver acoustically outputting the test sound into the ear canal.

19. The in-ear audio device of claim 18, wherein the processor is further configured to:

employ the sounds detected by the microphone that are indicative of the frequency response of the acoustic driver acoustically outputting the test sound into the ear canal to determine if the degree of sealing between the ear tip and the portion of the user's ear achieves a desired quality of frequency response of the acoustic driver acoustically outputting the test sound.

20. The in-ear audio device of claim 11, further comprising a pressure sensor, wherein the processing device is further configured to:

monitor a pressure exerted by the ear tip coupling to the portion of the ear; and cease application of the voltage to the piezoelectric material in response to the level of pressure being outside a predetermined range of pressure levels.

21. The apparatus of claim 11, further comprising a user interface comprising a manually-operable control, wherein the processing device is further caused to:

monitor the manually-operable control for an indication of the degree of sealing due to applying the voltage to the piezoelectric material causing discomfort to a user of the in-ear audio device; and cease application of the voltage to the piezoelectric material in response to the indication.

* * * * *